US009459579B2

(12) United States Patent
Shirafuji

(10) Patent No.: US 9,459,579 B2
(45) Date of Patent: Oct. 4, 2016

(54) IMAGE FORMING APPARATUS THAT CORRECTS IMAGE FORMING CONDITION BASED ON MEASUREMENT RESULT OF MEASUREMENT IMAGE

(71) Applicant: CANON KABUSHIKI KAISHA, Tokyo (JP)

(72) Inventor: Yasuhito Shirafuji, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/850,259

(22) Filed: Sep. 10, 2015

(65) Prior Publication Data

US 2016/0077458 A1 Mar. 17, 2016

(30) Foreign Application Priority Data

Sep. 17, 2014 (JP) ..... 2014-189444

(51) Int. Cl.
*G03G 15/00* (2006.01)
*G03G 15/043* (2006.01)

(52) U.S. Cl.
CPC ..... *G03G 15/5041* (2013.01); *G03G 15/043* (2013.01); *G03G 15/5058* (2013.01); *G03G 2215/00042* (2013.01); *G03G 2215/00059* (2013.01); *G03G 2215/00569* (2013.01)

(58) Field of Classification Search
CPC ..... G03G 15/043; G03G 15/5041; G03G 15/5058; G03G 2215/00033; G03G 2215/00042; G03G 2215/00059
USPC ..... 399/15, 49, 72
See application file for complete search history.

(56) References Cited

U.S. PATENT DOCUMENTS

| | | | | |
|---|---|---|---|---|
| 5,583,644 | A | 12/1996 | Sasanuma et al. | |
| 5,752,126 | A | 5/1998 | Muramatsu | |
| 6,021,288 | A * | 2/2000 | Okuno | B41J 29/393 399/49 |
| 2001/0031148 | A1 * | 10/2001 | Kajiwara | G03G 15/5058 399/49 |
| 2008/0131152 | A1 * | 6/2008 | Komiya | G03G 15/5062 399/49 |

* cited by examiner

*Primary Examiner* — Benjamin Schmitt
(74) *Attorney, Agent, or Firm* — Fitzpatrick, Cella, Harper & Scinto

(57) ABSTRACT

An image forming apparatus includes: a measuring unit configured to measure a plurality of measurement images, the plurality of measurement images including a first measurement image and second measurement images; a generation unit configured to generate a conversion condition based on second measurement data corresponding to the second measurement images; a first determination unit configured to determine an execution condition based on first measurement data corresponding to the first measurement image; and a second determination unit configured to determine a light intensity based on the first measurement data. A subsequent timing when the plurality of measurement images are to be formed is determined based on the execution condition, and an exposure unit updates the set light intensity to the light intensity determined by the second determination unit when the plurality of measurement images are formed at the subsequent timing.

20 Claims, 8 Drawing Sheets

FIG. 7

| DIFFERENCE X WITH RESPECT TO TARGET DENSITY | X≤−40 | −40<X≤−30 | −30<X≤−20 | −20<X<20 | 20≤X<30 | 30≤X<40 | 40≤X |
|---|---|---|---|---|---|---|---|
| AMOUNT OF CHANGE IN AMOUNT OF EXPOSURE LIGHT | +3 | +2 | +1 | NOT CHANGED | −1 | −2 | −3 |
| THRESHOLD VALUE N | 25 | 50 | 100 | 200 | 100 | 50 | 25 |

IMAGE FORMING APPARATUS THAT CORRECTS IMAGE FORMING CONDITION BASED ON MEASUREMENT RESULT OF MEASUREMENT IMAGE

BACKGROUND OF THE INVENTION

1. Field of the Invention

The present invention relates to a density correction technique for use in an image forming apparatus.

2. Description of the Related Art

Electrophotographic image forming apparatuses are required to provide density stability and tone stability of output images. For this reason, U.S. Pat. No. 5,752,126 and U.S. Pat. No. 5,583,644 disclose density correction control that stabilizes the quality of resulting images by forming a test pattern, which is a density correction image, detecting the density of the test pattern, and determining an image forming condition based on the detected density. The density correction control is executed, for example, each time image forming is performed on a predetermined number of sheets.

A variation in the characteristics of an image forming apparatus that affects the density and tone of output images is not always proportional to, for example, the number of image-formed sheets, and accordingly, the following problems may occur when density correction control is performed based on a predetermined number of image-formed sheets. For example, density correction control may be performed at an unnecessary timing despite the fact that the density of output images is stable, or density correction control may not be performed at a necessary timing despite the fact that the density of output images is changing. If density correction control is performed at an unnecessary timing, the productivity of the image forming apparatus decreases. If density correction control is not performed at a necessary timing, the quality of output images decreases.

SUMMARY OF THE INVENTION

According to an aspect of the present invention, an image forming apparatus includes: a converting unit configured to convert image data based on a conversion condition; a photosensitive member; an exposure unit configured to emit light based on a set light intensity and to expose the photosensitive member to the light based on the converted image data to form an electrostatic latent image; a developing unit configured to develop the electrostatic latent image to form an image on the photosensitive member; a transfer unit configured to transfer the image formed by the developing unit onto a sheet; a measuring unit configured to measure a plurality of measurement images formed on the photosensitive member by the exposure unit and the developing unit, the plurality of measurement images including a first measurement image and second measurement images; a generation unit configured to generate the conversion condition based on second measurement data corresponding to the second measurement images measured by the measuring unit; a first determination unit configured to determine an execution condition based on first measurement data corresponding to the first measurement image measured by the measuring unit; and a second determination unit configured to determine the light intensity based on the first measurement data. A subsequent timing when the plurality of measurement images are to be formed is determined based on the execution condition determined by the first determination unit, the exposure unit updates the set light intensity to the light intensity determined by the second determination unit when the plurality of measurement images are formed at the subsequent timing, and the conversion condition for converting the image data is updated to the conversion condition generated by the generation unit after generation of the conversion condition by the generation unit, and before the subsequent timing.

Further features of the present invention will become apparent from the following description of exemplary embodiments with reference to the attached drawings.

BRIEF DESCRIPTION OF THE DRAWINGS

FIG. 7 is a diagram showing correction information according to one embodiment.

DESCRIPTION OF THE EMBODIMENTS

Hereinafter, an exemplary embodiment of the present invention will be described with reference to the drawings. It is to be noted that the embodiment given below is merely an example, and thus is not intended to limit the scope of the present invention to the content of the embodiment. Also, in the diagrams described below, constituent elements that are not necessary in the description of the embodiment are not illustrated.

First Embodiment

Figure 1:
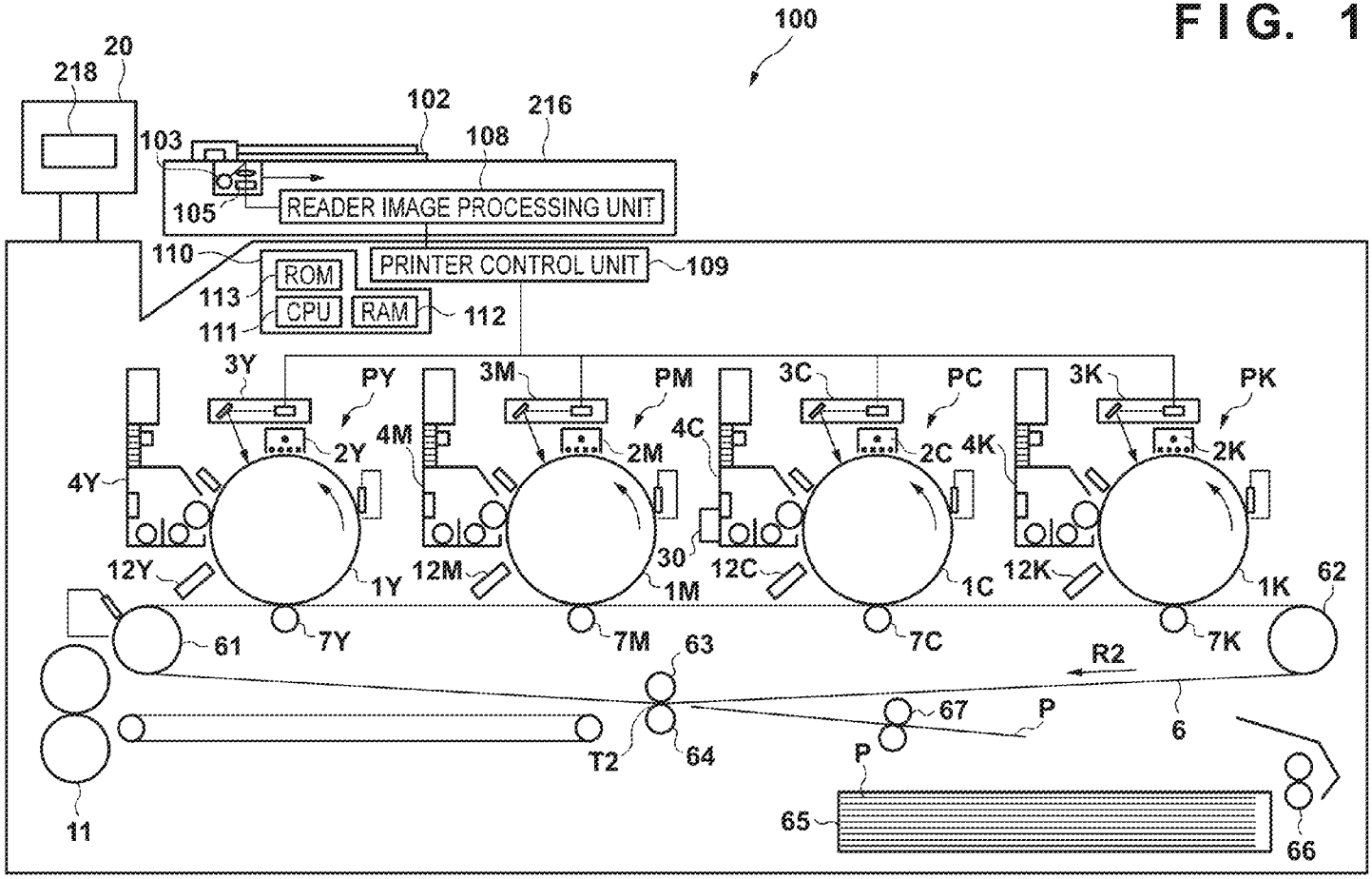
FIG. 1 is a configuration diagram of an image forming apparatus according to one embodiment.

FIG. 1 is a configuration diagram of an image forming apparatus 100 according to the present embodiment. In the image forming apparatus 100 shown in FIG. 1, yellow, magenta, cyan and black image forming units PY, PM, PC and PK are arranged along an intermediate transfer belt 6. The image forming unit PY includes a photosensitive member 1Y, which is an image carrier and is rotationally driven in a direction indicated by an arrow in the diagram and charged to a predetermined potential by a charging unit 2Y at the time of image forming. An exposure unit 3Y scans the photosensitive member 1Y with light, and exposes the photosensitive member 1Y to light so as to form an electrostatic latent image on the surface of the photosensitive member 1Y. A developing unit 4Y outputs a developing bias, and supplies a yellow toner (coloring material) to the electrostatic latent image formed on the photosensitive member 1Y so as to visualize the electrostatic latent image as a toner image. A primary transfer roller 7Y outputs a primary transfer bias so as to transfer the toner image formed on the photosensitive member 1Y onto the intermediate transfer belt 6. The image forming unit PY also includes a density sensor 12Y for detecting the density of the toner image formed on the photosensitive member 1Y. The density sensor 12Y emits light to, for example, the photosensitive member 1Y, and detects the density by using specularly reflected light. The configuration of the density sensor 12Y is not limited to detecting or measuring the density of the toner image formed on the photosensitive member, and the density sensor 12Y may be configured to measure the density of the toner image transferred onto the intermediate transfer belt 6, which will be described later.

The image forming units PM, PC and PK and the image forming unit PY have the same configuration except that a different toner color is used. Accordingly, a description of the image forming units PM, PC and PK is omitted here. In the following description, the image forming units will be indicated by the reference numeral without a suffix of Y, M, C or K unless it is necessary to distinguish the colors.

The intermediate transfer belt 6 is an image carrier held under tension by three rollers 61, 62 and 63, and is rotationally driven in a direction indicated by R2 in the diagram. As a result of the toner images formed on the photosensitive members 1 of the image forming units being transferred onto the intermediate transfer belt 6 in a superimposed manner, a full color toner image is formed on the intermediate transfer belt 6. A recording material P fed from a cassette 65 is conveyed toward a secondary transfer area T2 including a roller 63 and a secondary transfer roller 64 by roller pairs 66 and 67. The toner image that has been transferred onto the intermediate transfer belt 6 is then transferred onto the recording material P in the secondary transfer area T2. The recording material P is then heated and pressed by a fixing unit 11 so as to fix the toner image, and discharged to the outside of the apparatus.

A light source 103 provided in a reading unit 216 irradiates an original placed on an original platen 102 with light. A CCD sensor 105 provided in the reading unit 216 reads the original by receiving reflected light from the original. Image data corresponding to the original read by the reading unit 216 is subjected to image processing in a reader image processing unit 108, and transmitted to a printer control unit 109. The printer control unit 109 executes, on the transmitted image data, image processing corresponding to each image forming unit PY, PM, PC or PK. The image forming apparatus 100 according to the present embodiment is configured not only to obtain image data corresponding to an original read by the reading unit 216, but also to receive image data from a telephone line (FAX) or an external computer via a network. An operation unit 20 is used by the user so as to operate the image forming apparatus 100, and includes a display unit 218, such as a display, for displaying the state of the image forming apparatus 100. A control unit 110 performs overall control on image forming operations of the image forming apparatus 100, and includes a CPU 111 and storage units such as a RAM 112 and a ROM 113. The control unit 110 obtains the density of the toner image formed on the photosensitive member 1 based on a signal from the density sensor 12, which is a detection unit. The CPU 111 controls the image forming apparatus 100 by using programs and various types of data stored in the ROM 113, and the RAM 112 as a work area. By the CPU 111 executing the programs, target density information obtaining processing, density correction control using the reading unit 216, and density correction control using the density sensor 12, which will be described below, are executed. Furthermore, the image forming apparatus 100 includes an environmental sensor 30 that obtains internal environmental information of the image forming apparatus, for example, either or both of temperature and humidity, and informs the control unit 110 of the internal environmental information.

Figure 2:
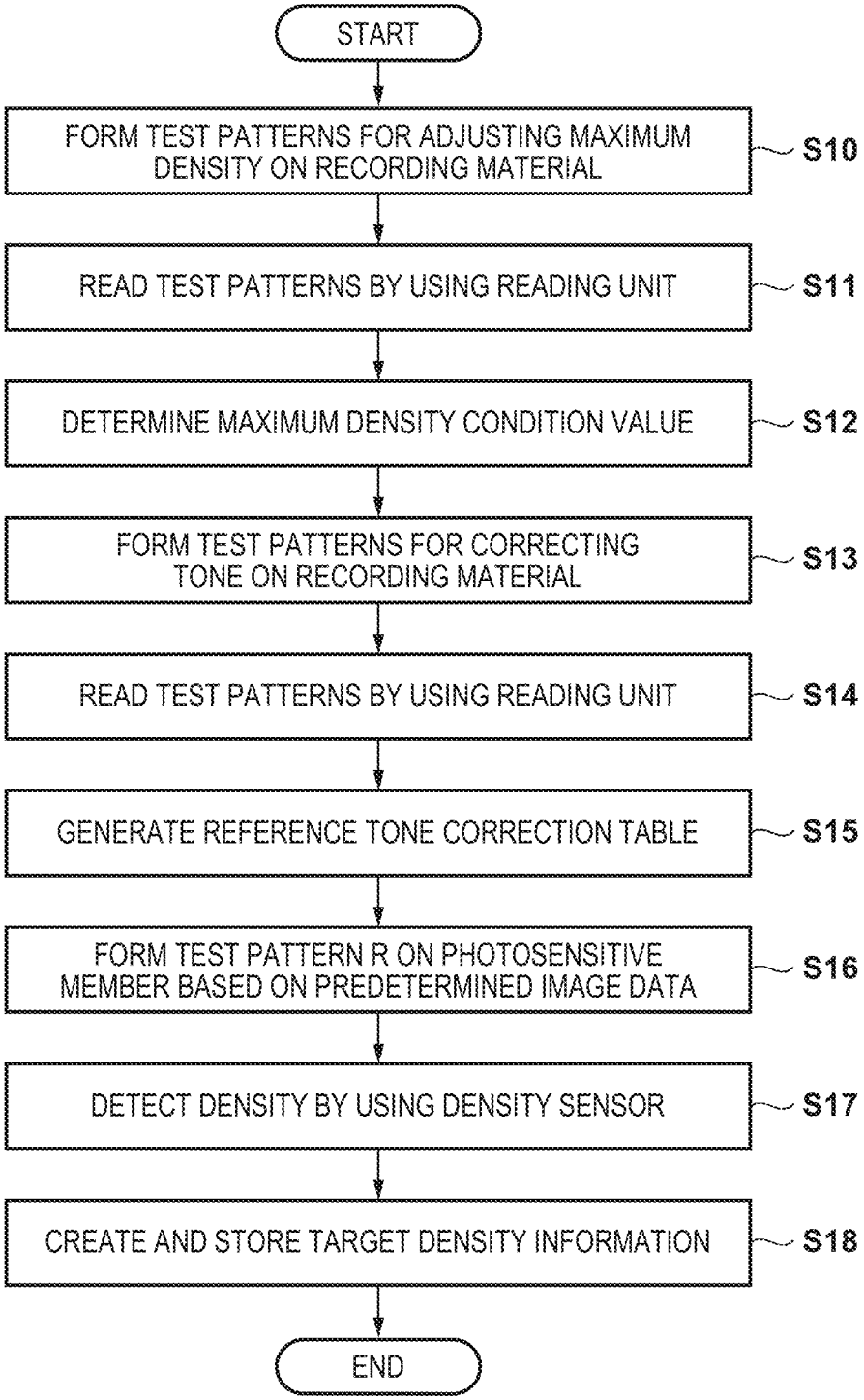
FIG. 2 is a flowchart of processing for obtaining target density information according to one embodiment.
Figure 3A:
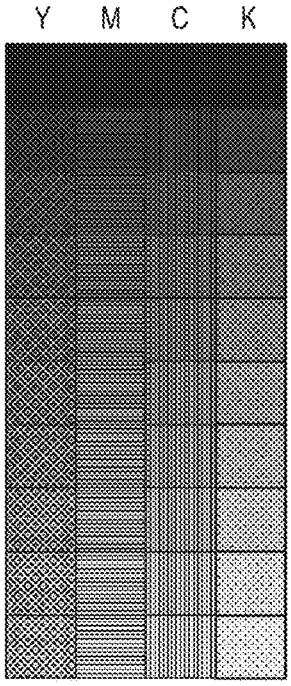
FIGS. 3A and 3B are diagrams showing test patterns formed on a recording material according to one embodiment.

Next is a description of the density correction control using the reading unit 216 and the target density information obtaining processing with reference to FIG. 2. In the case of executing the target density information obtaining processing, the control unit 110 carries out the density correction control using the reading unit 216. The processing shown in FIG. 2 is performed by a user operation or when a predetermined condition is satisfied, and is performed with respect to each color. In S10, the control unit 110 forms a plurality of test patterns on a recording material based on predetermined image data. FIG. 3A shows examples of test patterns formed in S10. The image forming units PY, PM, PC and PK each form ten test patterns for their color. The test patterns shown in FIG. 3A are test patterns formed by using, for example, a signal level of 255 if the image data is 8-bit data, and changing an image forming condition regarding density. In the following description, the amount of exposure light or exposure intensity is used as the image forming condition that is changed so as to control density, but a configuration is also possible in which another image forming condition regarding density is changed. To be specific, for example, a configuration may be used in which a value that determines a development contrast such as the developing bias supplied to the developing unit 4 or the charging bias supplied to the charging unit 2 is changed. Furthermore, a plurality of image forming conditions regarding density may be changed. The recording material having the test patterns of FIG. 3A formed thereon will be referred to as "test chart A". If the user places the test chart A on the reading unit 216 and issues an instruction to read the test chart A, in S11, the control unit 110 causes the reading unit 216 to read the test chart A, so as to measure the density of each test pattern. In S12, the control unit 110 determines, based on the density of each test pattern, an image forming condition with which the density of the toner image formed by using the predetermined image data as an input value achieves a target density. The target density is set to, for example, a maximum density that can be achieved by the image forming apparatus 100. As described above, in the present embodiment, the amount of exposure light is used as the image forming condition for achieving the target density. The determined image forming condition is stored in the RAM 112, and used in subsequent image forming operations.

Figure 3B:
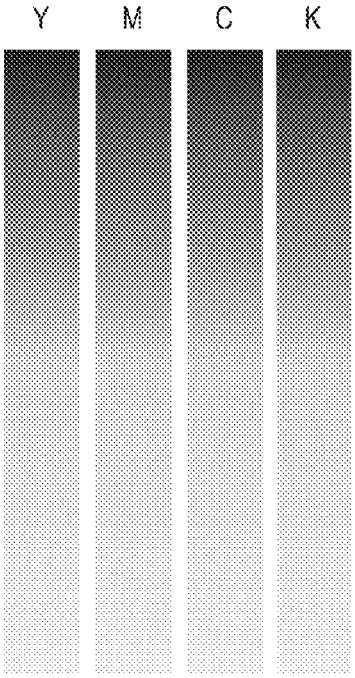
Figure 4A:
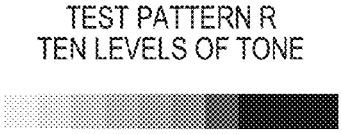
FIGS. 4A and 4B are diagrams showing test patterns formed on a photosensitive member according to one embodiment.
Figure 5:
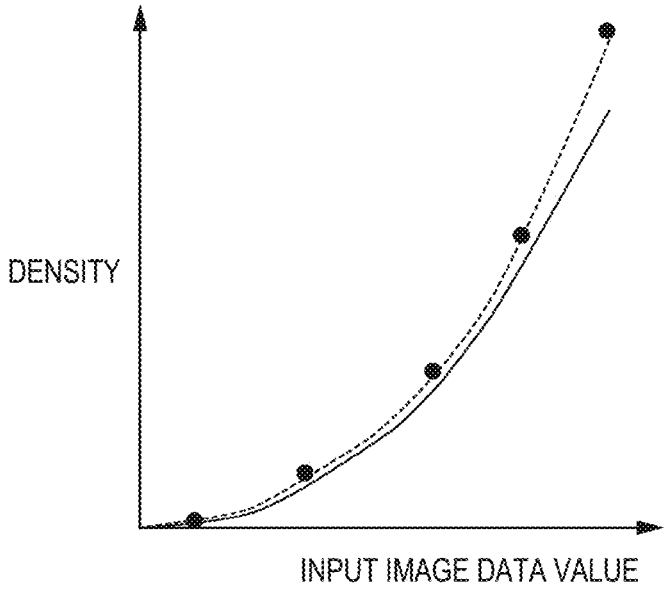
FIG. 5 is an illustrative diagram used to create a tone correction table in density correction control according to one embodiment.

Next, in S13, the control unit 110 forms test patterns for correcting tone on a recording material. FIG. 3B shows examples of test patterns formed in S13. The test patterns shown in FIG. 3B are test patterns formed by using, for example, a plurality of values selected from a range of 0 to 255, namely, 64 values if the image data is 8-bit data. The recording material having the test patterns of FIG. 3B formed thereon will be referred to as "test chart B". If the user places the test chart B on the reading unit 216 and issues an instruction to read the test chart B, in S14, the control unit 110 causes the reading unit 216 to read the test chart B, so as to measure the density of each test pattern. In S15, the control unit 110 generates a tone correction table (reference tone correction table) based on the density of each test pattern, and stores the tone correction table in the RAM 112. The tone correction table refers to information indicating a relationship between the input image data value (input value) and the value actually used in image forming (output value), and is a correction condition for correcting density characteristics of the image formed by the image forming apparatus 100. The control unit 110 corrects image data based on the tone correction table, and causes the image forming unit PY, PM, PC or PK to form an image based on the corrected image data, whereby an image having a desired density can be formed. If the target density characteristics is, for example, linear, the control unit 110 generates a tone correction table by reversing the relationship between the input value (255 value) of image data when the test chart B was formed and the density (255 value) of the test pattern of the test chart B. As the method for generating a tone correction table, any method can be used as long as the density characteristics of the image forming apparatus 100 can be corrected to desired density characteristics. After that, in S16, the control unit 110 forms a test pattern R having ten levels of tone as shown in FIG. 4A on the photosensitive member 1 based on the reference tone correction table generated in S15, and in S17, the density sensor 12 detects a density in the test pattern R. The control unit 110 sets each density detected in the test pattern R in S17 as a target density of the test pattern R, creates target density information indicating a relationship between the input value of image data and the target density of the test pattern R, and stores the target density information in the RAM 112 in S18. The solid line shown in FIG. 5 indicates the target density information stored in S18. The target density is determined by interpolation calculation because there are only ten input values of image data.

Figure 4B:
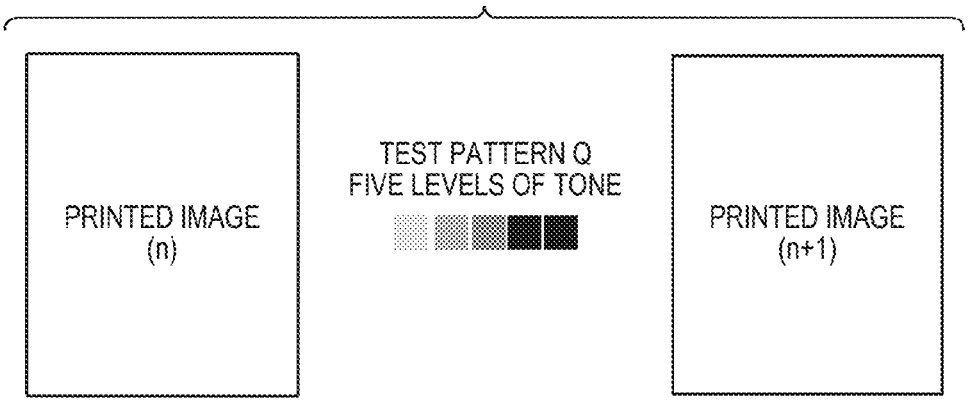
Figure 6:
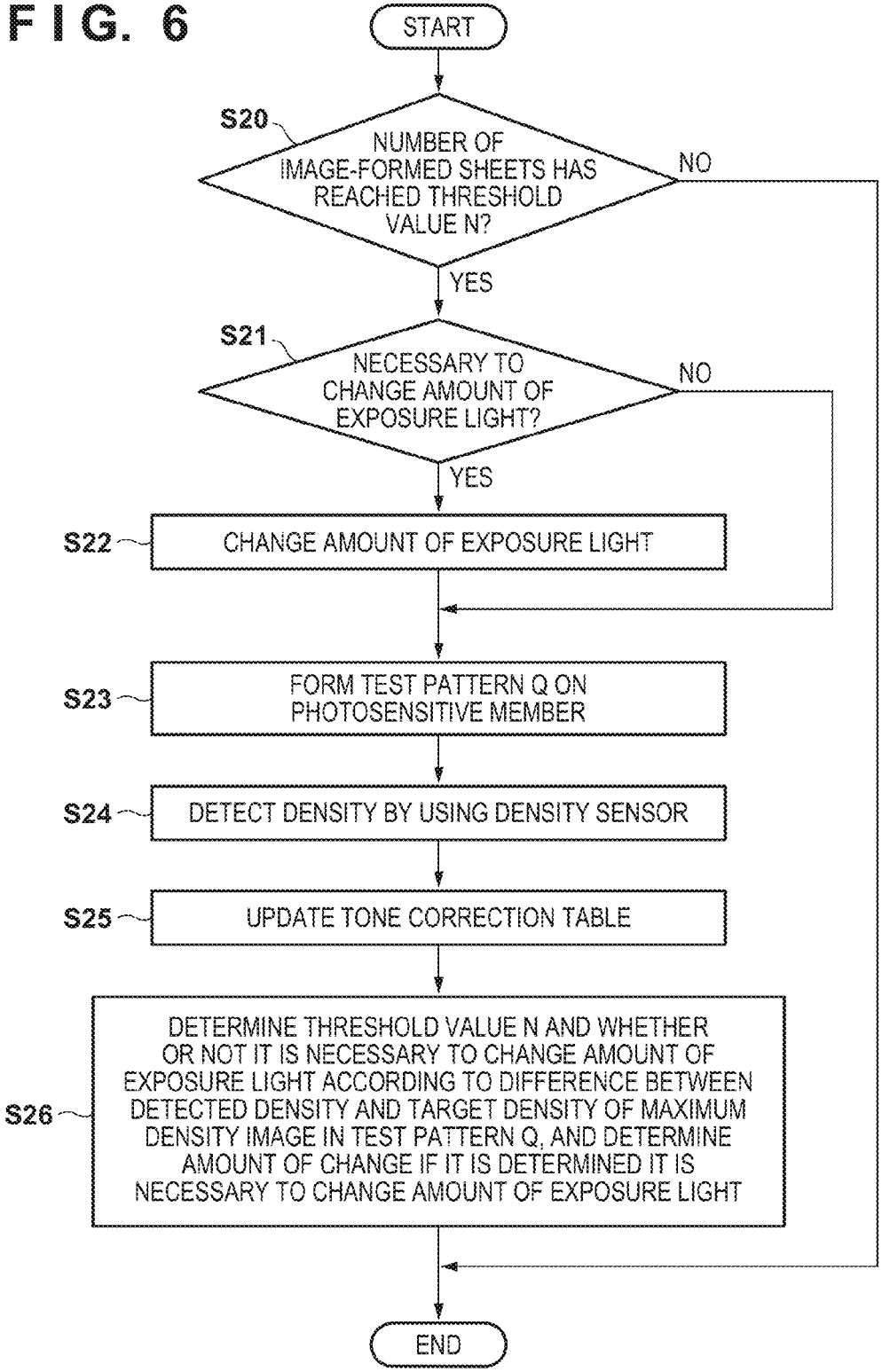
FIG. 6 is a flowchart of density correction control according to one embodiment.

A description is now given of the density correction control using the density sensor 12, which is carried out while the image forming apparatus 100 is forming a plurality of images, with reference to the flowchart of FIG. 6. The density correction control using the reading unit 216 has poor usability because it requires the user to place the test chart A and the test chart B on the original platen 102. For this reason, the control unit 110 executes the density correction control using the density sensor 12 in order to stabilize the output density during a period between previous execution of the density correction control using the reading unit 216 and subsequent execution of the density correction control using the reading unit 216. The density correction control using the density sensor 12 includes a tone correction (steps S13 to S15 of FIG. 2) and a maximum density correction (steps S10 to S12 of FIG. 2), as with the density correction control using the reading unit 216. However, unlike the density correction control using the reading unit 216, the density correction control using the density sensor 12 does not cause the reading unit 216 to read the test chart A and the test chart B. The tone correction using the density sensor 12 means to update the tone correction table (LUT) in S25. Likewise, the maximum density correction using the density sensor 12 means to set the amount of exposure light again. The control unit 110 executes determination processing shown in FIG. 6 each time one page's worth of image information is formed. Hereinafter, the determination processing will be described. In S20, after previous execution of the density correction control using the density sensor 12 or the target density information obtaining processing using the reading unit 216, the control unit 110 determines whether the number of image-formed sheets has reached a threshold value N. In other words, the control unit 110 determines whether or not the image forming unit PY, PM, PC or PK has formed N page's worth of image information. If it is determined in S20 that the number of image-formed sheets has not reached the threshold value N, the control unit 110 ends the determination processing. If it is determined that the number of image-formed sheets has reached the threshold value N, in S21, the control unit 110 determines whether or not it is necessary to change the amount of exposure light, and if it is determined that it is necessary to change the amount of exposure light, in S22, the control unit 110 changes the amount of exposure light. The method for determining whether or not it is necessary to change the amount of exposure light and the amount of adjustment if it is necessary to change the amount of exposure light will be described later. After that, the control unit 110 starts density correction control. First, in S23, the control unit 110 forms a test pattern Q having five levels of tone as shown in FIG. 4B on the photosensitive member 1. The test pattern Q includes a maximum density measurement image formed by using a maximum input value and density measurement images having a density other than the maximum density. That is, the test pattern Q having five levels of tone includes a maximum density measurement image. The maximum density measurement image in the test pattern Q is formed by using the same input value as the input value of image data used to form the maximum density test pattern in the test pattern R. That is, if the input value of image data is, for example, a level of 255, the test pattern Q includes images formed by a signal level of 255.

In S24, the control unit 110 detects the density of each measurement image in the test pattern Q by using the density sensor 12. Then, in S25, the control unit 110 updates the tone correction table (LUT) based on the target density corresponding to a measurement image in the test pattern Q and the result of measurement (density) of the measurement image formed on the photosensitive member 1 based on the input value of image data corresponding to the test pattern Q. The target density corresponding to the measurement image in the test pattern Q is the measurement result of the measurement image in the test pattern R, which was stored in the RAM 112 in the target density information obtaining processing shown in FIG. 2. To be specific, a relationship between image data values and measurement results (densities) of five measurement images is interpolated so as to obtain the current density characteristics indicated by the broken line in FIG. 5. Then, the tone correction table (LUT) is corrected such that a difference between the current density characteristics (broken line) and the target density information (solid line) is small. The corrected tone correction table (LUT) is stored in the RAM 112. The updated tone correction table (LUT) is used in subsequent image forming operations. In this way, the tone correction using the density sensor 12 is performed.

After that, in S26, the control unit 110 determines whether or not it is necessary to change the amount of exposure light in the subsequent correction control according to a difference between the measurement result (density) of the maximum density measurement image in the test pattern Q and the target density of the same. Furthermore, in S26, the control unit 110 determines the threshold value N, which is an execution condition for executing subsequent tone correction and maximum density correction, according to that difference. The threshold value N specifies the frequency of execution of the correction control, and the execution timing of subsequent correct control is adjusted by using the threshold value N. FIG. 7 shows a relationship between the amount of change (the amount of adjustment) used when the amount of exposure light is changed and the threshold value N with respect to a difference X between the measurement result of the maximum density measurement image in the test pattern Q and the target density, which is stored in the ROM 113 in advance, for example. If the difference X between the measurement result (detection result) and the target density takes a negative value, it indicates that the measured density (detection result) is lower than the target density. If the difference X takes a positive value, it indicates that the measured density is higher than the target density. As shown in FIG. 7, if the difference X is, for example, greater than −20 and less than +20, it is unnecessary to change the amount of exposure light. If, on the other hand, the difference X is 20 or greater, it is necessary to change the amount of exposure light. For example, if the difference X is 20 or more and less than +30, it means that the density of the measurement image is higher than the target density, and thus the amount of exposure light is reduced by one unit so as to lower the density of the image. The amount of exposure light is changed by electric power or the like supplied to the exposure unit 3. The control unit 110 controls the amount of exposure light by determining the amount of change (the amount of adjustment) based on the correction information shown in FIG. 7, and setting a parameter such as the electric power supplied to the exposure unit 3. Next, the method for setting the threshold value N will be described. If the difference X is greater than −20 and less than +20, the density characteristics exhibits less changes. In this case, the control unit 110 sets the threshold value N to, for example, 200. If, on the other hand, the absolute value of the difference X is greater than 20, it means that the density characteristics exhibits significant changes. If the absolute value of the difference X is greater than 20, the control unit 110 sets the threshold value N to a value smaller than 200 in order to increase the frequency of execution of the correction control. That is, if the difference X between the measured density and the target density exceeds a predetermined density, the control unit 110 reduces the threshold value N so as to increase the frequency of execution of the correction control.

In the processing of S26, the control unit 110 determines whether or not it is necessary to adjust the amount of exposure light, and if it is determined that it is necessary to adjust the amount of exposure light, the control unit 110 determines the amount of adjustment of the amount of exposure light. The control unit 110 stores, in the RAM 112, the result of determination made in S26 and the amount of adjustment determined in S26. The control unit 110 also stores the threshold value N determined in S26 in the RAM 112. Then, at the time of subsequent execution of the determination processing (S20), the control unit 110 reads the threshold value N from the RAM 112, and compares the threshold value N with the number of image-formed sheets. By doing so, the number of times of execution of correction control is suppressed if the density characteristics exhibits less changes, and the correction control is executed frequently if the density characteristics exhibits significant changes. Furthermore, in S21, the control unit 110 determines whether or not it is necessary to change the amount of exposure light based on the information stored in the RAM 112, and sets the amount of adjustment used when the amount of exposure light is changed by reading it from the RAM 112. The present embodiment is configured to, instead of immediately changing the amount of exposure light in S26, reflect the change at the time of subsequent execution of the density correction control using the density sensor 12. This is done so because if the amount of exposure light is changed immediately, the amount of exposure light used in subsequent image forming is different from the amount of exposure light used at the time of forming the test pattern Q, based on which the LUT was updated. That is, if image forming is performed by using an amount of exposure light that is different from the amount of exposure light based on which the LUT used was determined, it is not possible to properly correct tone.

Figure 8:
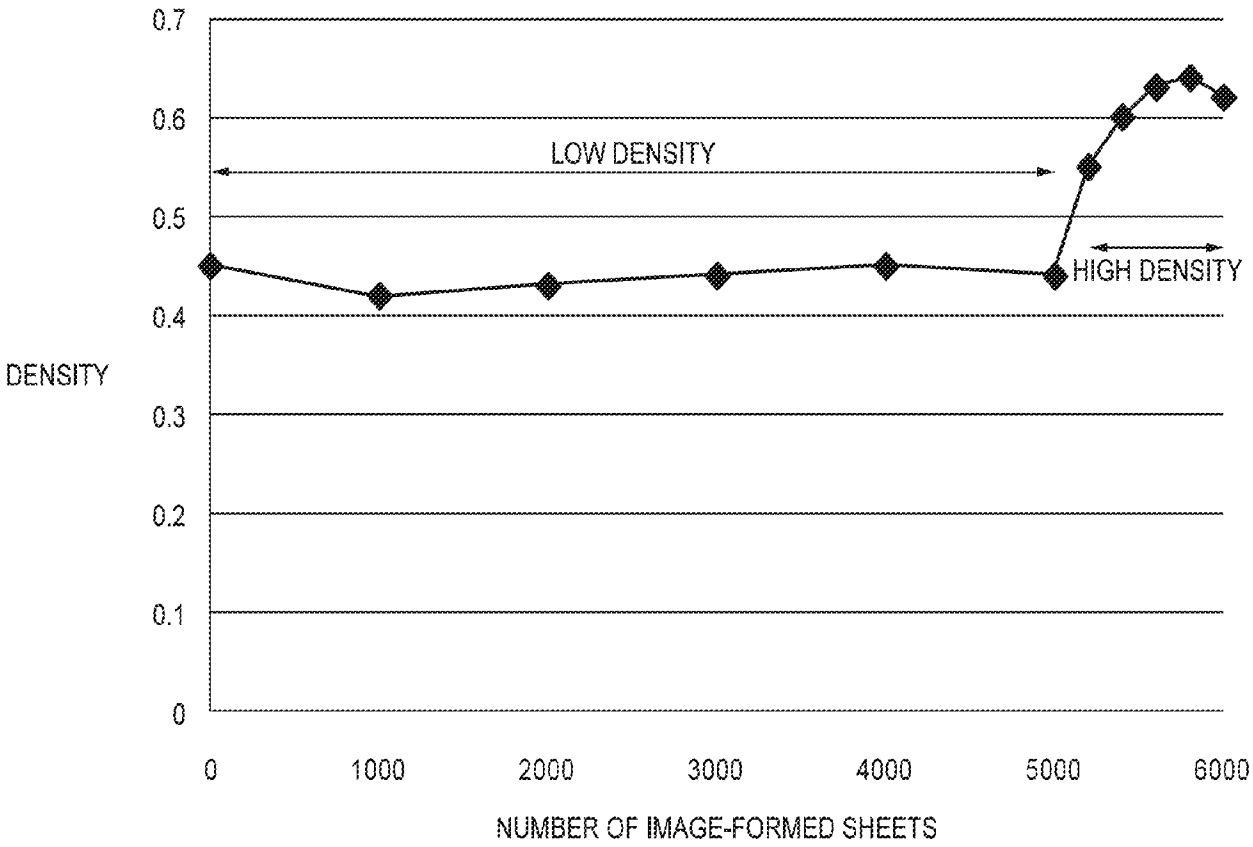
FIG. 8 is an illustrative diagram illustrating effects according to one embodiment.

FIG. 8 is a diagram showing changes in output density in the case where the frequency of execution of the density correction control using the density sensor 12 was fixed. The diagram shows changes in the density of a predetermined intermediate density image in the case where 5000 low density images are continuously formed and thereafter 1000 high density images are continuously formed. As used herein, "low density image" refers to an image in which the toner application area is about 0.5% with respect to the total area of the recording material, and "high density image" refers to an image in which the toner application area is about 50% with respect to the total area of the recording material. Continuously forming low density images increases the time during which toner is stirred in the developing unit 4, resulting in an increase in the amount of charge of toner. If the amount of charge of toner increases, the amount of toner applied to the electrostatic latent image formed on the photosensitive member decreases, and thus the formed image has a low density. However, the density correction control using the density sensor 12 corrects the amount of exposure light and the tone correction table, and thus variations in the density of the image are suppressed, and images having the target density can be formed. After that, when forming of high density images starts, the time during which toner is stirred in the developing unit 4 is shortened, and the amount of charge of toner drops rapidly. If the amount of charge of toner drops, the amount of toner attached to the electrostatic latent image formed on the photosensitive member increases. In the case where the threshold value N used in the density correction control is fixed to 100, the amount of exposure light and the tone correction table are not corrected at an appropriate timing, and thus it is not possible to keep up with the rapid changes in the density characteristics, and significant variations occur in the image density.

Figure 9:
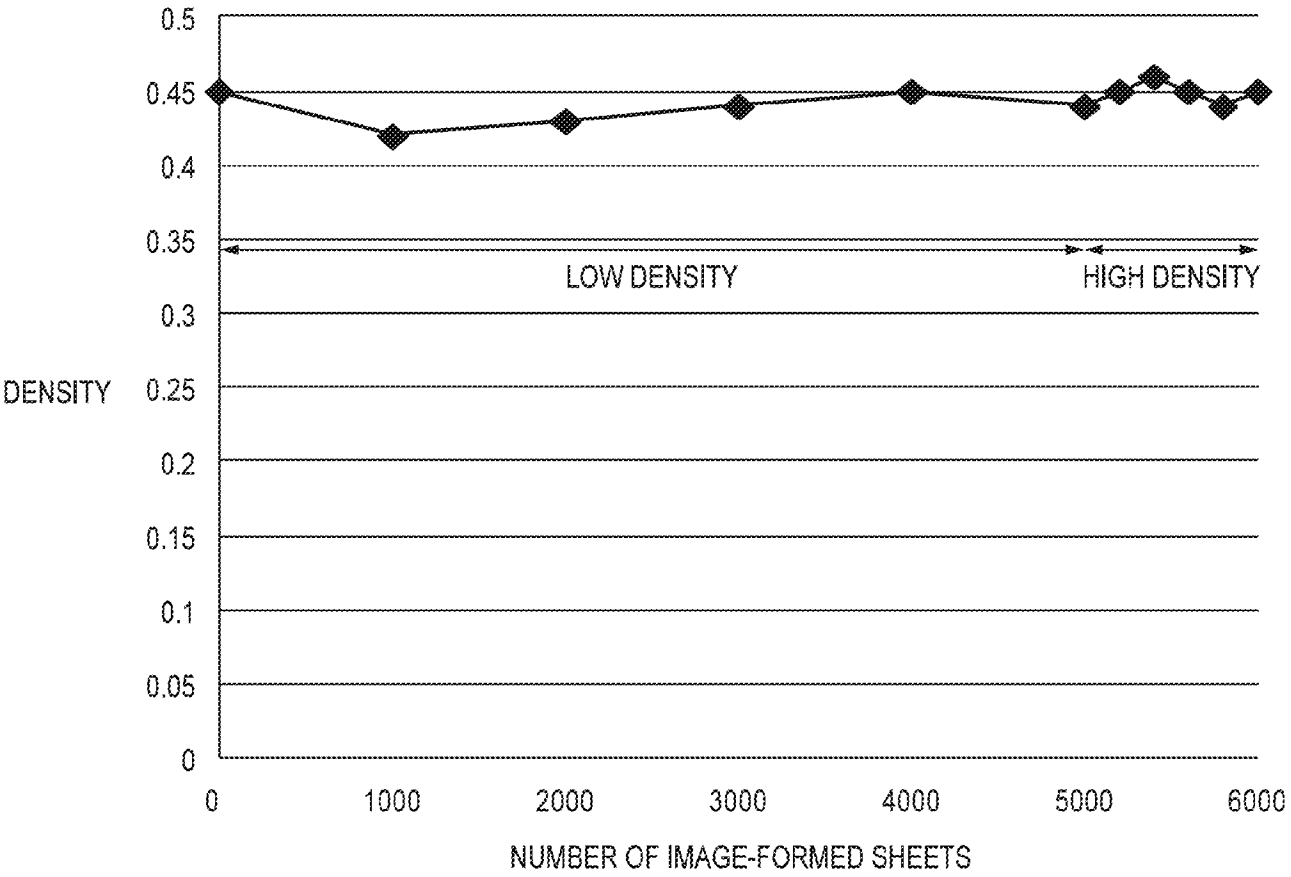
FIG. 9 is an illustrative diagram illustrating effects according to one embodiment.

On the other hand, FIG. 9 is a diagram showing changes in output density in the case where the threshold value N used in the density correction control was changed based on the correction information shown in FIG. 7. The measurement conditions were the same as those of FIG. 8. In this case, after the start of forming of high density images, the threshold value N was changed to 25, and accordingly, the frequency of execution of the density correction control increased as compared to the conventional configuration (FIG. 8). For this reason, the image density was maintained at a substantially constant level even when the density characteristics varied significantly. Also, after 2000 low density images had been formed, the threshold value N was changed to 200, and thus the frequency of execution of the density correction control decreased. Accordingly, productivity was improved as compared to the conventional configuration (FIG. 8) because the frequency of execution of the density correction control using the density sensor 12 is suppressed if the variation in the density characteristics is small, while the image density is maintained at a substantially constant level.

Note that specific values used in the embodiment described above are merely examples. For example, the test pattern R has ten levels of tone and the test pattern Q has five levels of tone, but the test patterns may have a different number of tone levels. Also, in the embodiment described above, the threshold value N is determined based on the measured density of the maximum density image of the test pattern Q and the target density of the same. However, the threshold value N may be determined by a difference between the measured density of a measurement image other than the maximum density measurement image in the test pattern Q and a target density corresponding to that measurement image. In the present embodiment, the number of image-formed sheets is used as a parameter used to determine whether or not to execute density correction control, but it is also possible to use other parameters such as an elapsed time since the previous update of the tone correction table. Furthermore, in the processing shown in FIG. 2, the density of the test pattern R is read by the reading unit 216, but it is also possible to use a configuration in which, for example, the test pattern formed on a recording material is read by a sensor provided on the downstream side of the fixing unit 11.

In addition, in the embodiment described above, the control unit 110 is configured to, in S25 of FIG. 6, update the tone correction table (LUT) based on the measurement results (densities) of all measurement images in the test pattern Q and the target densities. However, the control unit 110 may be configured to update the tone correction table (LUT) based on the measured densities of measurement images other than the maximum density measurement image in the test pattern Q and the target densities for the measurement images other than the maximum density measurement image in the test pattern Q. In this case, the control unit 110 makes an assumption that the measured density of the maximum density measurement image is the target maximum density, and updates the tone correction table (LUT) based on the assumed target maximum density, the measured densities of measurement images other than the maximum density measurement image, and the target densities for the measurement images other than the maximum density measurement image.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-189444, filed on Sep. 17, 2014, which is hereby incorporated by reference herein in its entirety.

What is claimed is:

1. An image forming apparatus comprising:

a converting unit configured to convert image data based on a conversion condition;

a photosensitive member;

an exposure unit whose light intensity is controlled, and configured to expose the photosensitive member based on the converted image data to form an electrostatic latent image;

a developing unit configured to develop the electrostatic latent image to form an image on the photosensitive member;

a transfer unit configured to transfer the image developed by the developing unit onto a sheet;

a measuring unit configured to measure a plurality of measurement images formed on the photosensitive member by the exposure unit and the developing unit, the plurality of measurement images including a first measurement image and second measurement images;

a controller configured to control the exposure unit and the developing unit to form the plurality of measurement images on the photosensitive member, and to control the measuring unit to measure the plurality of measurement images;

a generation unit configured to generate the conversion condition based on second measurement data corresponding to the second measurement images measured by the measuring unit; and a determination unit configured to determine an execution timing and the light intensity of the exposure unit based on first measurement data corresponding to the first measurement image measured by the measuring unit, wherein the controller is further configured to control, based on the execution timing determined by the determination unit, a subsequent timing at which the plurality of measurement images are to be formed, wherein the controller is further configured to update the light intensity of the exposure unit to the light intensity determined by the determination unit at the subsequent timing, and wherein the conversion condition is updated before the subsequent timing.

2. The image forming apparatus according to claim 1, wherein the generation unit generates the conversion condition based on the first measurement data corresponding to the first measurement image and the second measurement data corresponding to the second measurement images.

3. The image forming apparatus according to claim 1, further comprising:

a reading unit configured to read a test chart formed on the sheet by the photosensitive member, the exposure unit, the developing unit and the transfer unit;

another generation unit configured to generate the conversion condition based on a reading result by the reading unit; and another determination unit configured to control the converting unit to convert measurement image data based on the conversion condition generated by the other generation unit, control other measurement images to be formed on the photosensitive member based on the converted measurement image data, and determine target data based on measurement results of the other measurement images by the measuring unit, wherein the generation unit generates the conversion condition based on the second measurement data corresponding to the second measurement images and the target data determined by the other determination unit.

4. The image forming apparatus according to claim 1, wherein the determination unit determines a number of pages on which the image has been formed by the image forming apparatus as the execution timing.

5. The image forming apparatus according to claim 4, wherein the determination unit determines the number of pages based on a difference between the first measurement data and target data, and the number of pages decreases as the difference increases.

6. The image forming apparatus according to claim 1, wherein the determination unit determines an elapsed time as the execution timing.

7. The image forming apparatus according to claim 6, wherein the determination unit determines the elapsed time based on a difference between the first measurement data and target data, and the elapsed time decreases as the difference increases.

8. The image forming apparatus according to claim 1, wherein the determination unit determines correction data for correcting the light intensity based on the first measurement data, wherein the controller increases the light intensity to form the plurality of measurement images at the subsequent timing based on the correction data if a density corresponding to the first measurement data is lower than a target density, and wherein the controller decreases the light intensity to form the plurality of measurement images at the subsequent timing based on the correction data if the density corresponding to the first measurement data is higher than the target density.

9. The image forming apparatus according to claim 1, wherein the first measurement image has the highest density among the plurality of measurement images.

10. The image forming apparatus according to claim 1, wherein the conversion condition is a tone correction table for correcting density characteristics of the image data to target density characteristics.

11. An image forming apparatus comprising:

a converting unit configured to convert image data based on a conversion condition;

a photosensitive member;

an exposure unit whose light intensity is controlled, and configured to expose the photosensitive member based on the converted image data to form an electrostatic latent image;

a developing unit configured to develop the electrostatic latent image to form an image on the photosensitive member;

an image carrier onto which the image developed by the developing unit on the photosensitive member is transferred;

a transfer unit configured to transfer the image formed on the image carrier onto a sheet;

a measuring unit configured to measure a plurality of measurement images formed on the image carrier, the plurality of measurement images including a first measurement image and second measurement images;

a controller configured to control the exposure unit and the developing unit to form the plurality of measurement images on the image carrier, and to control the measuring unit to measure the plurality of measurement images;

a generation unit configured to generate the conversion condition based on second measurement data corresponding to the second measurement images measured by the measuring unit; and a determination unit configured to determine an execution timing and the light intensity of the exposure unit based on first measurement data corresponding to the first measurement image measured by the measuring unit, wherein the controller is further configured to control, based on the execution timing determined by the determination unit, a subsequent timing at which the plurality of measurement images are to be formed, wherein the controller is further configured to update the light intensity of the exposure unit to the light intensity determined by the determination unit at the subsequent timing, and wherein the conversion condition is updated before the subsequent timing.

12. The image forming apparatus according to claim 11, wherein the generation unit generates the conversion condition based on the first measurement data corresponding to the first measurement image and the second measurement data corresponding to the second measurement images.

13. The image forming apparatus according to claim 11, further comprising:

a reading unit configured to read a test chart formed on the sheet by the photosensitive member, the exposure unit, the developing unit and the transfer unit;

another generation unit configured to generate the conversion condition based on a reading result by the reading unit; and another determination unit configured to control the converting unit to convert measurement image data based on the conversion condition generated by the other generation unit, control other measurement images to be formed on the image carrier based on the converted measurement image data, and determine target data based on measurement results of the other measurement images by the measuring unit, wherein the generation unit generates the conversion condition based on the second measurement data corresponding to the second measurement images and the target data determined by the other determination unit.

14. The image forming apparatus according to claim 11, wherein the determination unit determines a number of pages on which the image has been formed by the image forming apparatus as the execution timing.

15. The image forming apparatus according to claim 14, wherein the determination unit determines the number of pages based on a difference between the first measurement data and target data, and the number of pages decreases as the difference increases.

16. The image forming apparatus according to claim 11, wherein the determination unit determines an elapsed time as the execution timing.

17. The image forming apparatus according to claim 16, wherein the determination unit determines the elapsed time based on a difference between the first measurement data and target data, and the elapsed time decreases as the difference increases.

18. The image forming apparatus according to claim 11, wherein the determination unit determines correction data for correcting the light intensity based on the first measurement data, wherein the controller increases the light intensity to form the plurality of measurement images at the subsequent timing based on the correction data if a density corresponding to the first measurement data is lower than a target density, and wherein the controller decreases the light intensity to form the plurality of measurement images at the subsequent timing based on the correction data if the density corresponding to the first measurement data is higher than the target density.

19. The image forming apparatus according to claim 11, wherein the first measurement image has the highest density among the plurality of measurement images.

20. The image forming apparatus according to claim 11, wherein the conversion condition is a tone correction table for correcting density characteristics of the image data to target density characteristics.

* * * * *